US012448977B2

(12) United States Patent
Mischiatti

(10) Patent No.: US 12,448,977 B2
(45) Date of Patent: Oct. 21, 2025

(54) REGENERATIVE MULTI-STAGE COMPRESSOR

(71) Applicant: M Pumps Process Srl, Taglio di Po (IT)

(72) Inventor: Antonio Mischiatti, Taglio di Po (IT)

( * ) Notice: Subject to any disclaimer, the term of this patent is extended or adjusted under 35 U.S.C. 154(b) by 203 days.

(21) Appl. No.: 18/001,792

(22) PCT Filed: Jun. 22, 2020

(86) PCT No.: PCT/IB2020/055860
§ 371 (c)(1),
(2) Date: Dec. 14, 2022

(87) PCT Pub. No.: WO2021/255508
PCT Pub. Date: Dec. 23, 2021

(65) Prior Publication Data

US 2023/0235741 A1 Jul. 27, 2023

(30) Foreign Application Priority Data

Jun. 19, 2020 (IT) ..... 102020000014818

(51) Int. Cl.

| | |
|---|---|
| ***F04D 23/00*** | (2006.01) |
| ***F04B 53/06*** | (2006.01) |
| ***F04D 5/00*** | (2006.01) |
| ***F04D 25/02*** | (2006.01) |
| ***F04D 25/06*** | (2006.01) |
| ***F04D 29/02*** | (2006.01) |
| ***F04D 29/054*** | (2006.01) |
| ***F04D 29/08*** | (2006.01) |

(Continued)

(52) U.S. Cl.
CPC ..... *F04D 23/008* (2013.01); *F04D 25/026* (2013.01); *F04D 25/06* (2013.01); *F04D 29/266* (2013.01); *F04D 29/284* (2013.01); *F04B 53/06* (2013.01); *F04D 5/002* (2013.01); *F04D 29/023* (2013.01); *F04D 29/054* (2013.01); *F04D 29/083* (2013.01)

(58) Field of Classification Search
CPC ..... F04D 23/008; F04D 25/026; F04D 25/06; F04D 29/266; F04D 29/284; F04D 5/002; F04D 29/023; F04D 29/054; F04D 29/083; F04B 53/06
See application file for complete search history.

(56) References Cited

U.S. PATENT DOCUMENTS 4,943,208 A * 7/1990 Schoenwald ..... F04D 23/008 415/55.1
4,984,964 A * 1/1991 Callerio ..... F04D 23/008 415/55.4

(Continued)

FOREIGN PATENT DOCUMENTS

| | | |
|---|---|---|
| EP | 0346720 | 12/1989 |
| EP | 0459269 | 12/1991 |

*Primary Examiner* — David N Brandt
(74) *Attorney, Agent, or Firm* — Themis Law

(57) ABSTRACT

A compressor of the regenerative type configured to work at pressures exceeding 50 bars includes a motor, a magnetic drive coupling connected to the motor and adapted to transmit the rotary motion to a drive shaft, which is mechanically connected to the magnetic drive coupling, and two peripheral impellers mounted on the drive shaft.

12 Claims, 6 Drawing Sheets

(51) Int. Cl.
*F04D 29/26* (2006.01)
*F04D 29/28* (2006.01)

(56) References Cited

U.S. PATENT DOCUMENTS

| | | | | | |
|---|---|---|---|---|---|
| 5,334,004 | A * | 8/1994 | Lefevre | F01D 11/04 | 415/113 |
| 5,591,000 | A * | 1/1997 | Fischer | F04D 29/624 | 415/214.1 |
| 2006/0269394 | A1 | 11/2006 | Shizu | | |
| 2009/0025399 | A1 * | 1/2009 | Kamen | C02F 1/18 | 165/184 |
| 2012/0073950 | A1 * | 3/2012 | Kamen | F04D 23/008 | 202/187 |
| 2019/0242388 | A1 * | 8/2019 | Krines | F04D 29/266 | |

* cited by examiner

REGENERATIVE MULTI-STAGE COMPRESSOR

FIELD OF THE INVENTION

The present patent concerns the compressors that operate with gases, and more specifically it concerns a new regenerative multi-stage compressor specifically designed to operate with gases.

BACKGROUND OF THE INVENTION

Single-stage compressors are known, which produce a pressure increase in the gas by increasing the rotation speed of the impeller in a single stage.

When said compressors work with a gas having low molecular weight such as, for example, ammonia, hydrogen, helium, methane, etc., the speed increase needed to reach the required pressure brings some disadvantages.

Firstly, in order for the compressor to work at high speeds, it is necessary to install very expensive bearings made of a ceramic material and often it is also necessary to use lubricating grease.

The introduction of grease in the machine in turn involves the risk of contaminating the process gas, with serious consequences for the equipment that will be subsequently served by the compressor.

In addition to the above, the speed increase causes the temperature to increase inside the machine, which thus cannot maintain its thermal balance. This drawback limits the field of application of the machine, since the speed increase reduces the reliability of the compressor, which requires more frequent maintenance operations. In some specific fields, instead, maintenance operations cannot always be carried out frequently but only at scheduled intervals that must be as wide as possible.

Regenerative compressors are defined as turbomachines with tangential flow having a low specific speed (in the order of 0.03, while centrifugal compressors have a specific speed in the order of 0.1 and radial compressors have a specific speed in the order of 0.5), high head and low flow rates. These characteristics, together with advantages related to the fact that they are not subject to stall or pumping instability, make these compressors very interesting for use in several fields such as, for example, in the chemical, petrochemical, pharmaceutical industry.

In literature, regenerative compressors are also defined as peripheral compressors or turbines or drag compressors. Even though this configuration has been mainly used to pump liquids, some theories, supported by semi-empirical expressions, have been presented in literature to explain the behavior of this type of machine when it is used to process gases.

A theory describes the pumping mechanism: the regenerative compressor is provided with an impeller having peripheral radial blades. When the impeller rotates in the direction of the flow, the fluid is pushed among the blades towards the periphery of the impeller and then again backwards, towards the base of other blades. This recirculation takes place several times through a large number of blades, between the suction mouth and the delivery mouth, producing a sort of multi-stage or regenerative effect. The path of the fluid is geometrically similar to a helical spring curved to form an incomplete circle, wherein each cycle adds energy to the fluid.

According to some authors, the friction present between the impeller and the fluid is due to the turbulent motion as the main force causing the pumping action. These authors propose the idea that the pumping mechanism be induced by the shearing stress created by the impeller in the fluid.

SUMMARY OF THE INVENTION

The subject of the present patent is a new type of multi-stage compressor of the regenerative type, equipped with a magnetic drive coupling and specifically designed to operate with gases.

The special and new combination of the technical characteristics of the new compressor make it possible to achieve several advantages, in addition to eliminating the drawbacks mentioned above.

It is an important object of the present invention to provide a compressor in which more than one stage are exploited to produce the required pressure increase and thus eliminate the drawbacks posed by the single-stage compressors of the known type.

More specifically, it is one object of the present invention to provide a compressor in which the rotation speed of the impellers is reduced, thus reducing the generation of heat compared to single-stage compressors. Consequently, bearings lubricated with grease are not needed, dry bearings being used instead.

Since there is no contaminant inside the machine, the processed gas will not be subjected to any alteration and therefore the new compressor is highly reliable.

Thanks to the reduced generation of heat, the compressor works at much lower temperatures and therefore is safer, especially when processing gases classified as explosive. The compressor allows the condition of thermal balance to be maintained more easily and heat accumulation to be avoided. Consequently, the operation of all the components of the compressor is more reliable: connected electric motor, bearings, windings.

These and other direct and complementary objects are achieved by the new regenerative multi-stage compressor, specifically designed and developed to operate with gases.

The new compressor is of the regenerative type, according to the definition provided above, and comprises:

- a motor;
- at least one magnetic drive coupling connected to said motor and suited to transmit the rotary motion to at least one drive shaft;
- said drive shaft mechanically connected to said coupling;
- a first impeller directly or indirectly connected to said shaft in a mechanical manner;
- at least one second impeller directly or indirectly connected to said shaft in a mechanical manner.

Each one of said impellers is of the peripheral type, meaning that it comprises a disc provided with radial or twisted blades mounted on one or both sides of the disc according to the dimensions of the machine and the performance expected based on the design.

Said impellers rotate integrally with said shaft, which in turn is supported by bearings. In the preferred configuration, said shaft comprises at least two supports, for example at its two opposite ends, while said impellers are mounted on said shaft in the space included between the two supports.

The new compressor thus comprises at least two stages. Each stage preferably comprises two half shells with one of said impellers mounted therebetween. For each stage, each of said impellers rotates in a peripheral annular duct obtained between said half shells. Said annular duct communicates with a gas suction mouth on one side, coils forming an angle of approximately 360° and ends in proximity to a delivery mouth. Said annular duct is interrupted by a preferably removable element that separates the low-pressure side, meaning the side where the suction mouth is located, from the high-pressure side, meaning the side where the delivery mouth is located. Said two stages are substantially equal to each other but are oriented in such a way that they are offset, conveniently by 180°, to counterbalance the radial loads, which as a consequence are considerably reduced, further contributing to increasing the duration of the bearings and therefore of the entire machine.

Between the two stages there is an annular cavity that serves the function of internal communication manifold between the two stages and allows them to be offset.

The new compressor comprises sealing elements mounted in proximity to the impellers, locked mechanically and provided with a labyrinth outline, which separate the scroll, in which said set of blades of the impellers rotates, from the inner chamber that is closest to the shaft, thus maximizing the sealing effect and the volumetric efficiency thanks to the minimized internal recirculation due to leakages. In order to guarantee that clearances are respected, and maintenance costs minimized, said scaling elements are made with wearing or sacrificial parts.

The new compressor solves a further drawback, thus eliminating another factor that reduces efficiency. The new compressor comprises a dynamic barrier against recirculation, obtained through the presence of a plurality of projections located on said shaft and rotating integrally with the shaft with extremely reduced clearances against sealing elements constrained between the shaft and said containment cups. In an alternative embodiment, the shaft may be without projections while a sealing element provided with teeth can be interposed between the shaft and said containment bodies. The compressor comprises a plurality of scaling elements suited to guarantee static sealing. For example, and preferably, the compressor comprises a plurality of pairs of O rings placed side by side, between which a path is created for monitoring any leakages of the first O ring that can be connected to monitoring equipment.

In order to guarantee the effective internal recirculation of gas, which is necessary to guarantee the thermal balance of the compressor, the latter comprises a gas recirculation system made up of a series of passages and ducts obtained from elements of various types, as described and claimed here below.

Each impeller is provided with holes that place said scroll, in which the blades of the impeller rotate, in communication with said inner chamber, meaning the chamber that is closest to the shaft, thus slightly pressurizing said inner chamber itself.

The path of the gas is described here below, for example starting from the lower impeller, meaning the impeller that is farther from the coupling and that defines, by way of example, the second stage.

The gas path continues through a series of preferably axial holes, that is, holes whose axis is parallel to the rotation axis, made in the discs of said impellers.

The gas reaches the lower bearings, meaning the bearings that are farther from the coupling, and flows through them. If necessary, said supports of the bearings can be provided with suitable passages intended to maximize the gas flow through the bearings.

The gas flow continues through an axial hole obtained inside said shaft, between its lower end, farther from the coupling, and the opposite upper end, closer to the coupling. In said upper end, or in proximity to the same, there is a passage through which the gas flows out of the shaft, flows through a passage between the body containing the internal magnet and the internal magnet itself and reaches the support of the upper bearing, through which the gas flows, as described with reference to the lower bearing.

Alternatively, if the support is provided with passages, the gas flows also through said passages, which allows a higher flow rate to be obtained.

Finally, through a further duct made in the suction chamber, the gas reaches the suction chamber itself, at low pressure, and mixes with the gas entering the first stage.

In order to make the system even more efficient, in addition to generating a difference in pressure between the scroll of the first stage and the suction chamber, the new compressor preferably comprises two other important devices.

The first device is a tangential fan positioned at the lower end of said shaft and having the function to direct the gas downwards.

The second device is constituted by one or more grooves made on the external surface of said internal magnet, in particular in an helical shape, in such a way as to guide the gas flow in the area of the containment body.

Further innovative characteristics concern said supports of the bearings, which are mechanically fixed to the other fixed parts of the compressor. In an alternative solution, said supports comprise a series of axial recesses that allow the gas to flow therethrough, as described above.

In the absence of said recesses, the gas in any case flows through the bearings, in such a way as to cool them.

In the case where bearings requiring the use of lubricant are installed, it is possible to provide a manifold configured in such a way as to collect the deposited grease and hold it, thus preventing its dispersion.

Said magnetic drive coupling that supplies the torque to the shaft can be of any type available on the market and have a containment body made of metal, ceramic, polymeric compounds, carbon fiber or other materials. The internal magnet, that is the magnet that rotates inside said containment body, can be located in any position, according to the construction or design needs.

BRIEF DESCRIPTION OF THE DRAWINGS

The characteristics of the new compressor are illustrated in greater detail in the following description, with reference to the attached drawings which are enclosed hereto by way of non-limiting example.

FIG. 4 shows a sectional view of an impeller (3, 4), while

FIG. 6 shows a three-dimensional view of a tangential fan (9), while

DETAILED DESCRIPTION OF EMBODIMENTS OF THE INVENTION

Figure 1:
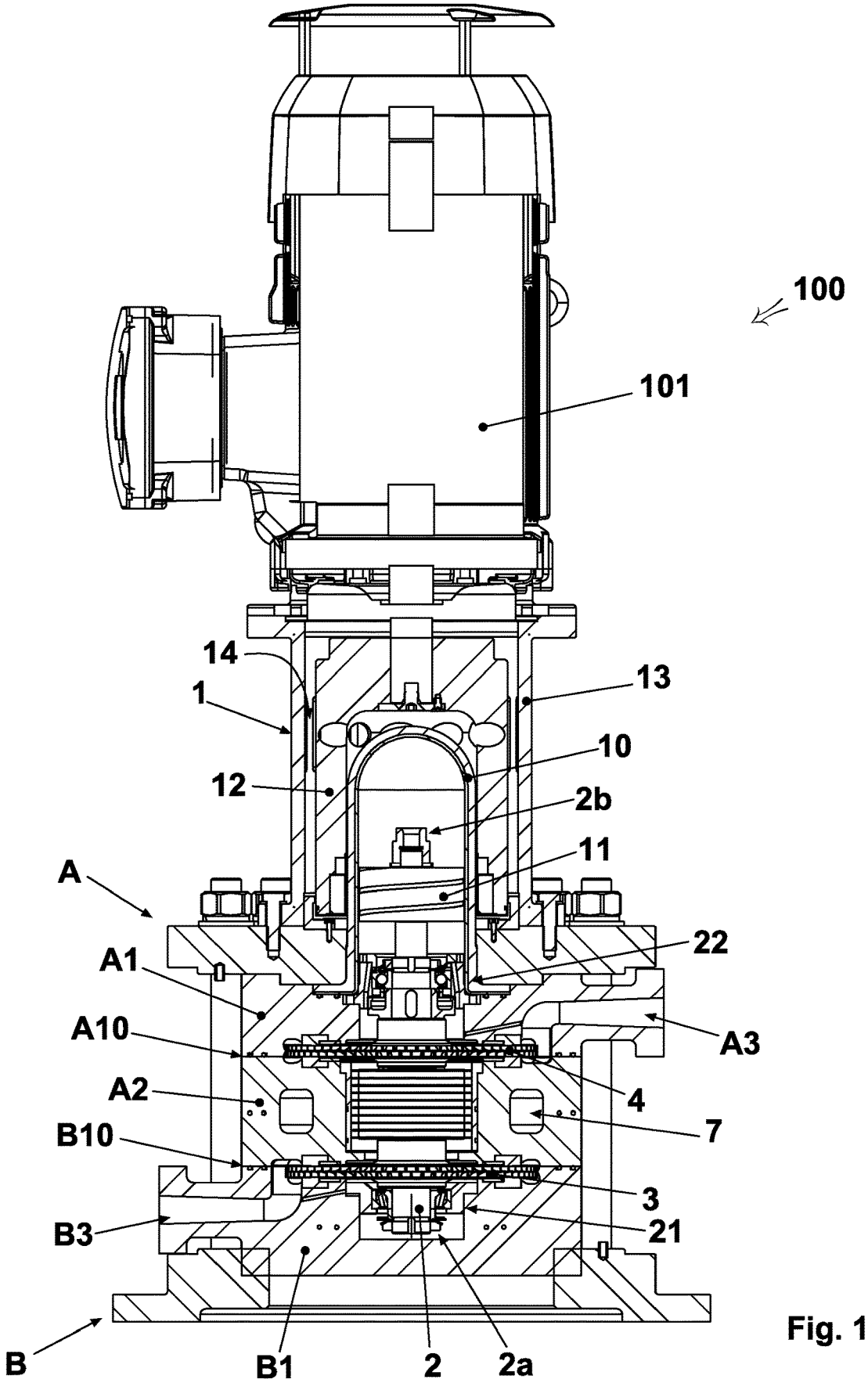
FIG. 1 shows a sectional view of the new multi-stage compressor (100). According to the invention, said coupling (1) can be mounted in an opposite manner with respect to what is shown in FIG. 1, where the coupling (1), in particular, is mounted in such a way that the cup (10) containing the internal magnet (11) faces towards the inside of the compressor (100). In the opposite configuration, said containment cup (10) can be mounted in such a way that it faces the opposite direction.
Figure 1A:
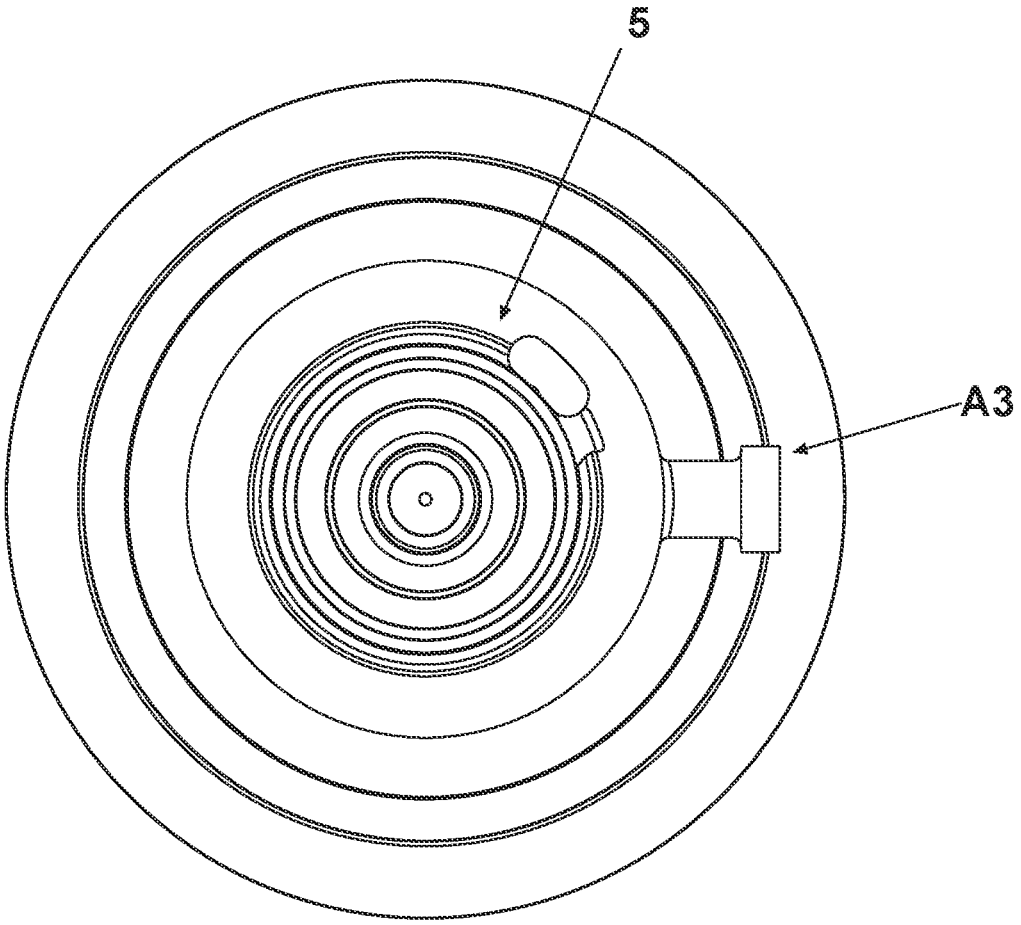
Figure 2:
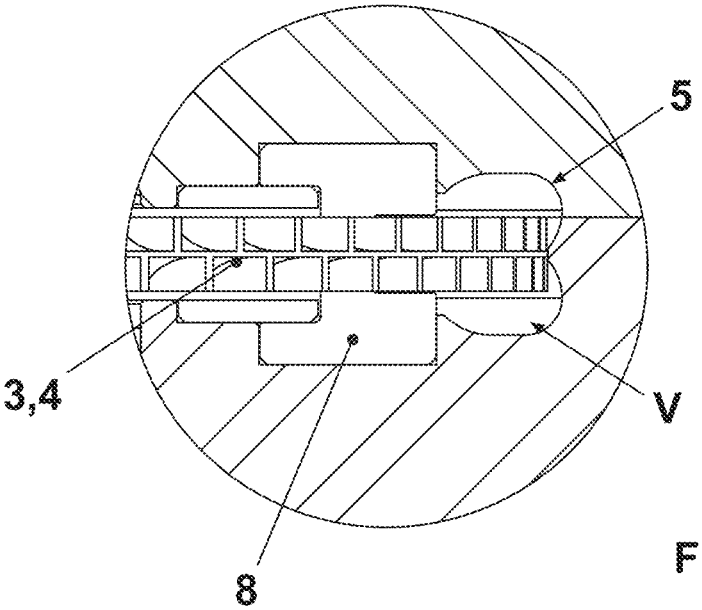
FIG. 2 shows a detail of part of an impeller (3, 4) and of the scaling elements.

The invention is a compressor (100) particularly suited to operate with gases, comprising a motor (101), at least one coupling (1), preferably of the magnetic type, connected to said motor (101) and suited to transmit the rotary motion to at least one drive shaft (2).

Said drive shaft (2), mechanically connected to said coupling (1), is in turn supported by bearings (23) in at least two supports (21, 22), for example in proximity to the two opposite lower (2*a*) and upper (2*b*) ends.

The compressor (100) comprises at least two impellers (3, 4), each mechanically connected, directly or indirectly, to said shaft (2), and wherein said impellers (3, 4) are mounted on said shaft (2) in the space included between said two supports (21, 22).

Each one of said impellers (3, 4) is of the peripheral type, comprising a disc (31, 41) provided with a set of blades (32, 42) mounted on one or both sides of the disc (31, 41). The new compressor (100) thus comprises at least two stages (A, B), wherein each stage (A, B) comprises a shell (A10, B10), in turn constituted by half shells (A1, A2, B1) between which one of said impellers (3, 4) is installed.

Each one of said impellers (3, 4) rotates in a peripheral annular duct (5) obtained in said shell (A10, B10), wherein said annular duct (5) communicates on one side with a gas suction mouth (visible in FIG. 1 for the first stage A and indicated by A3), coils forming an angle of approximately 360° and ends in proximity to a delivery mouth (visible in FIG. 1 for the second stage B and indicated by B3).

For example, said annular duct (5) is interrupted by a preferably removable element that separates the low-pressure side, meaning the side where said suction mouth is located, from the high-pressure side, meaning the side where said delivery mouth is located. Said at least two stages (A, B) are substantially equal to each other but are oriented in such a way that they are offset, for example and preferably by 180°.

Between said two shells (A10, B10) of said impellers (3, 4) there is an annular cavity (7) with ducts for communication with the scrolls (V) of the impellers, serving the function of an internal manifold to allow said stages (A, B) to be offset.

One or more sealing elements (8) are mounted in proximity to the impellers (3, 4), mechanically locked and provided with a labyrinth outline, which separate the scroll (V), in which said set of blades (32, 42) of the impellers (3, 4) rotates, from an inner chamber that is closer to said shaft (2).

Figure 3:
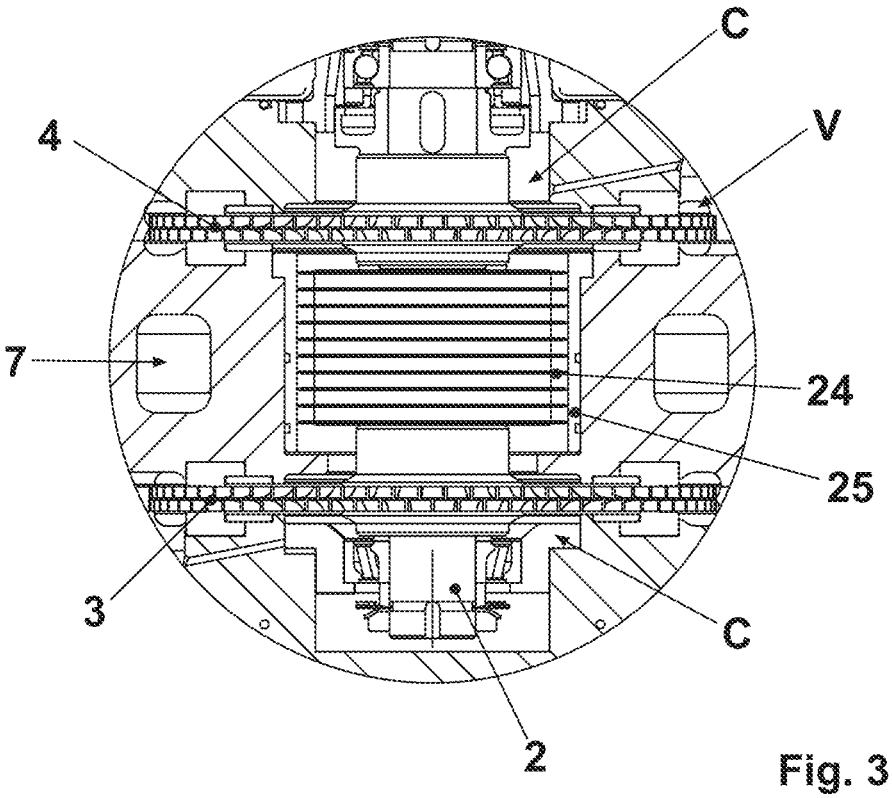
FIG. 3 shows a detail of the shaft (2) according to a possible embodiment.
Figure 4A:
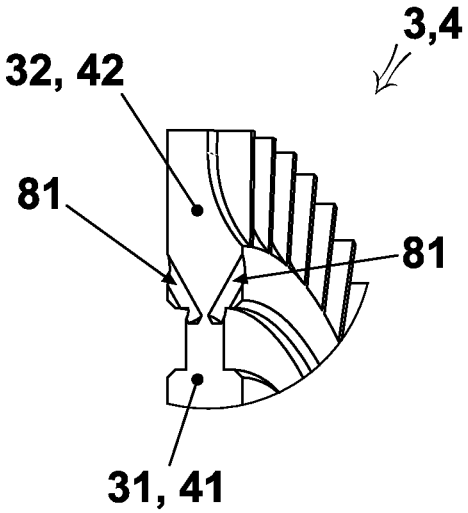
FIG. 4*a* shows a detail of the same impeller, where it is possible to observe the communication channels (31) between the scroll (V) and the inner chamber.
Figure 4:
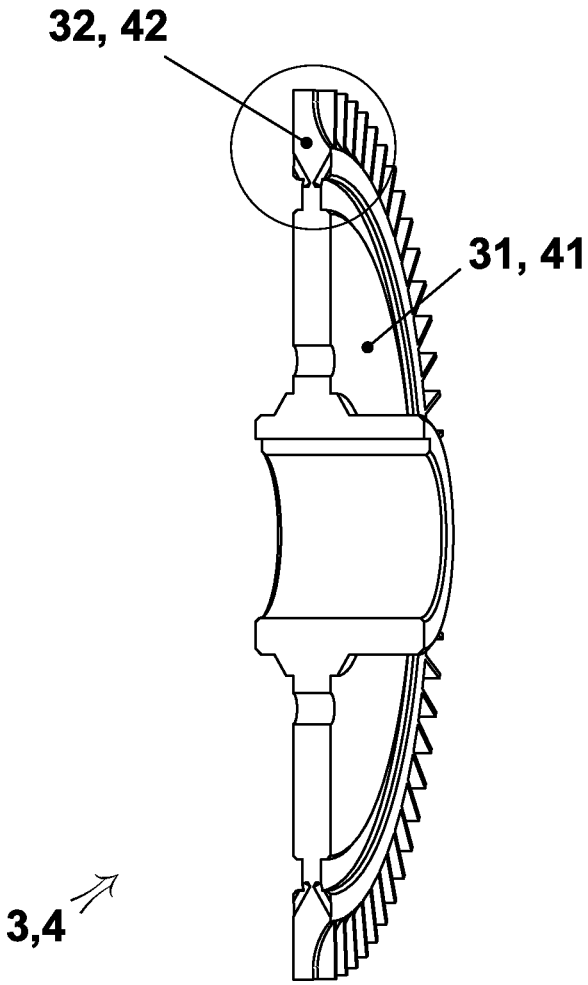

According to a first solution shown in FIG. 3, to form a dynamic barrier against gas recirculation, on said shaft (2), between said impellers (3, 4), there is a plurality of projections (24) that rotate against one or more sealing elements (25) constrained between said shaft (2), at the level of said projections (24), and said shells (A10, B10). In an alternative solution not shown in the figures, one or more sealing elements equipped with teeth are interposed between said shaft (2) and said shells (A10, B10).

According to the invention, in order to guarantee static scaling, pairs of gaskets and O rings (G) placed side by side are installed between the elements that make up the fixed parts of the compressor (100), a path for monitoring any leakages of the first O ring suited to be connected to monitoring equipment being created between said pairs of gaskets and O rings.

Figure 5:
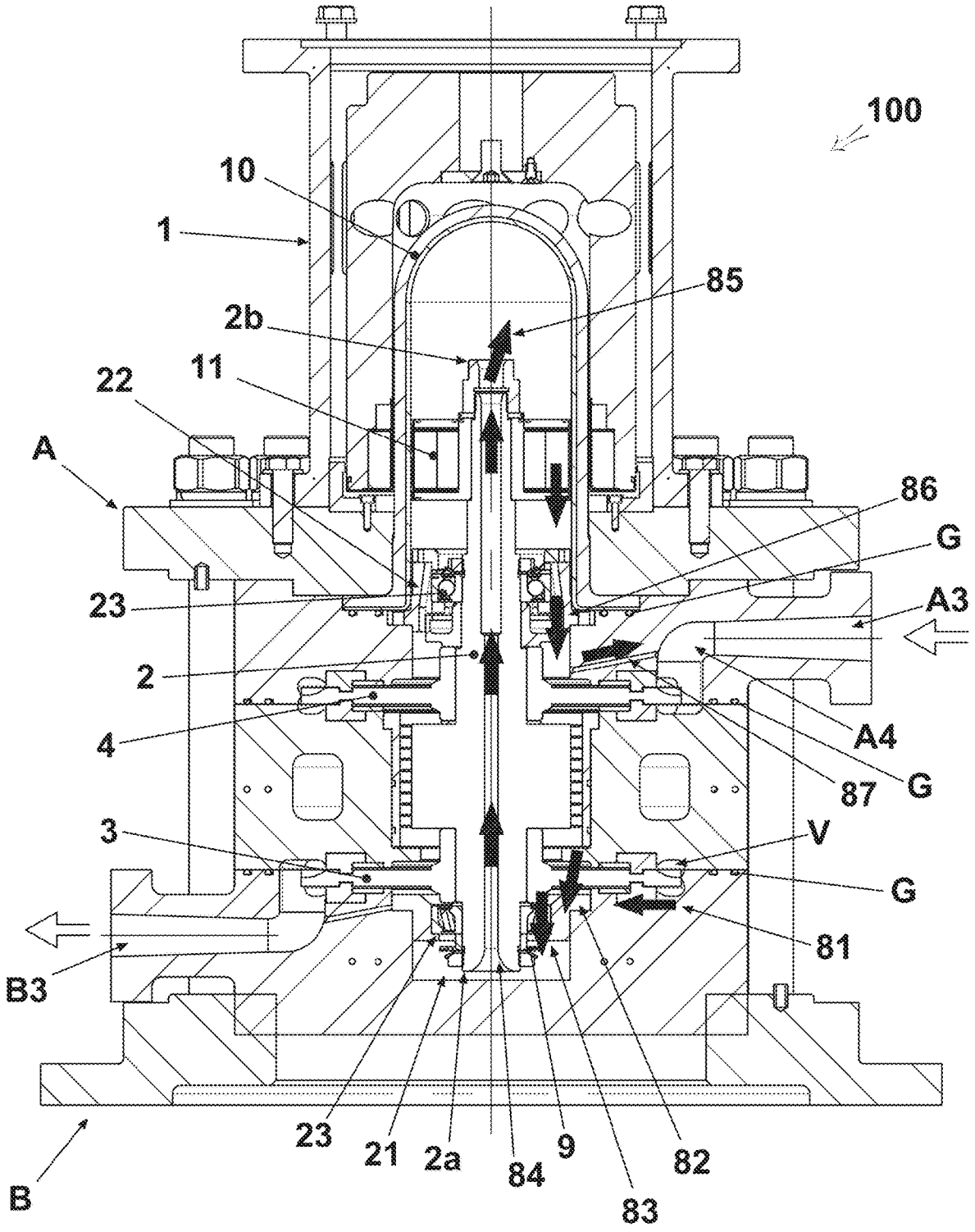
FIG. 5 shows a sectional view of part of the compressor (100) schematically illustrating the gas recirculation path.
Figure 6:
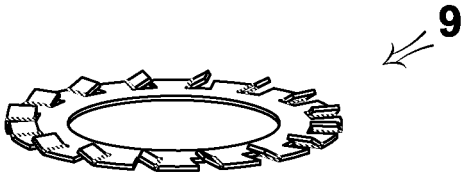

The gas recirculation path, which serves the function of guaranteeing the thermal balance inside the compressor (100), is schematically shown in FIG. 5. Supposing to start from the second stage (B), meaning from said lower impeller (3) farther from the coupling (1), the gas flows from the scroll (V) into said inner chamber, flowing through one or more holes or channels (81) created in said impeller (3) and placing said scroll (V) in communication with said inner chamber.

Said discs (31, 41) of the impellers (3, 4) are provided with one or more holes or ducts (82) that place said inner chamber in communication with said bearings (23), wherein said gas flows into said bearings (23) through said holes or ducts (82).

In a possible solution, said supports (21, 22) of the bearings (23) are provided with suitable holes or ducts (83, 86) for the passage of gas, designed to maximize the gas flow through the bearings (23) themselves.

The gas then flows into the shaft (2) through an axial hole, from its lower end (2*a*) to its upper end (2*b*) closer to the coupling (1).

In said upper end (2*b*) of the shaft (2) or in proximity to the same there is a passage (85) that places the inside of said axial hole (84) of the shaft (2) in communication with the inside of a containment cup (10) containing said coupling (1), in which at least one internal magnet (11) is housed.

Figure 7:
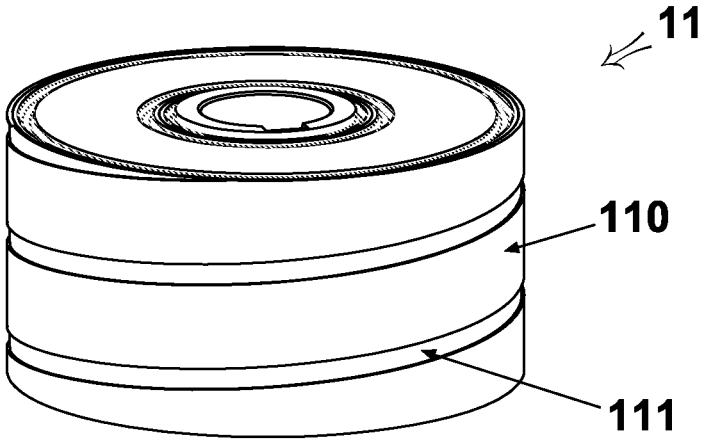
FIG. 7 shows the internal magnet (11) and its external covering (110) provided with a helical groove (111).
Figure 8:
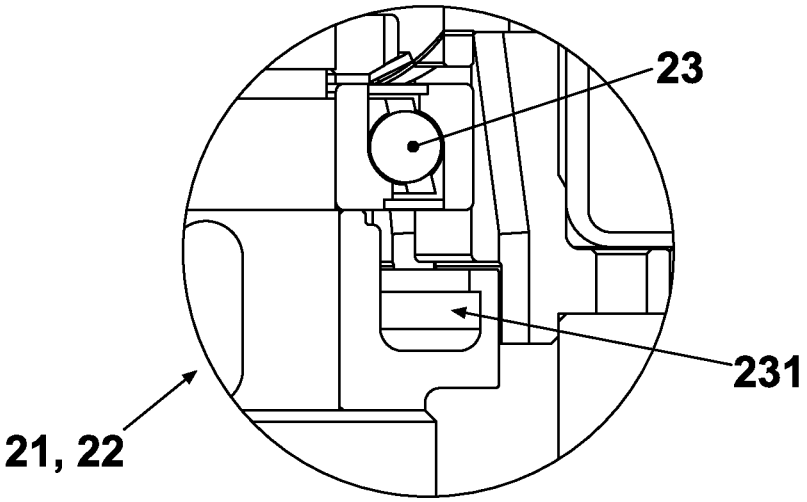
FIG. 8 shows a detail of the manifold (231) designed to contain the lubricant in the case where lubricated bearings (23) are installed in the compressor (100).

As shown in FIG. 7, the external surface (110) of said internal magnet (11) is provided with one or more grooves (111) designed to guide the gas flow in the area of said containment cup (10). Said one or more grooves (111) are preferably helical in shape.

Said cup (10) containing the coupling (1) is made of metal, ceramic, polymeric compounds, carbon fiber or other materials.

The gas then flows through the upper bearings (23) and/or through further passages (86) obtained in said upper support (22) and reaches said inner chamber of the first stage (A). Said inner chamber (C) communicates with a suction chamber (A4) via a communication duct (87) through which the gas coming from said coupling (1) enters the suction chamber (A4) itself and mixes with the inflowing gas.

The compressor (100) preferably comprises also a tangential fan (9) positioned at the lower end of said shaft (2) and serving the function of directing the gas downwards.

According to the invention, furthermore, the new compressor (100) may comprise means for generating a further air flow intended to cool the top of the compressor (100), that is, the part where the external magnet (12) of the coupling (1) is located.

According to the invention, the external casing (13) of said external magnet (12) is provided with one or more holes or openings, conveniently protected by filtering caps that let air flow therethrough.

Furthermore, said external magnet (12) can be provided with an integrated fan, for example in the upper part of the external magnet (12) itself, which generates the desired flow in the hollow space (14) between the external magnet (12) and said external casing (13).

Therefore, with reference to the above description and the attached drawings, the following claims are expressed.

The invention claimed is:

1. A regenerative compressor, configured to work at pressures exceeding 50 bars, comprising:

a motor;

a magnetic drive coupling connected to said motor and configured to transmit a rotary motion to a drive shaft, said drive shaft being mechanically connected to said magnetic drive coupling;

a plurality of impellers, each of said impellers being mechanically connected, directly or indirectly, to said drive shaft, each of said impellers being of a peripheral impeller and comprising a disc equipped with a set of blades mounted on one or both of two sides of the disc; and a plurality of stages, each stage comprising a shell having one of said impellers mounted therein, wherein each one of said impellers rotates in a peripheral annular duct obtained in said shell, and wherein said annular duct communicates on one side of the duct with a gas suction mouth, and ends adjacently to a delivery mouth, wherein said drive shaft is supported by bearings in at least two supports, wherein said plurality of impellers is mounted on said drive shaft in a space included between said at least two supports, wherein said shaft comprises a plurality of projections, arranged between said plurality of impellers, the plurality of projections rotating against one or more sealing elements constrained between said shaft, at a level of said plurality of projections, and said shells, and wherein said shaft is provided with an axial hole for passage of gas along said shaft.

2. The regenerative compressor according to claim 1, wherein each stage of said plurality of stages are oriented so as to be offset from each other, and wherein between said shells of said impellers there is an annular cavity serving as an internal manifold, forming part of the annular duct, to allow said stages to be offset.

3. The regenerative compressor according to claim 1, further comprising sealing elements mounted adjacently to the impellers to separate a scroll, in which said set of blades of the impellers rotates, from an inner chamber closer to said shaft than the scroll.

4. The regenerative compressor according to claim 3, wherein each of said impellers is provided with holes or channels that place said scroll, in which the blades of the impeller rotate, in communication with said inner chamber.

5. The regenerative compressor according to claim 3, wherein said discs of the impellers comprise one or more holes or ducts that place said inner chamber in communication with said bearings.

6. The regenerative compressor according to claim 1, wherein said at least two supports of the bearings are provided with holes or ducts configured for passage of gas.

7. The regenerative compressor according to claim 1, wherein an upper end of said shaft extends into a containment cup, an internal magnet being housed in said containment cup, said internal magnet having one or more grooves that enable a movement of said gas within said containment cup.

8. The regenerative compressor according to claim 7, wherein said containment cup containing the coupling is made of metal, ceramic, polymeric compounds, or carbon fiber, and is arranged to have an axis parallel to or coinciding with an axis of said shaft and facing towards an inside of the compressor or in an opposite direction.

9. The regenerative compressor according to claim 1, further comprising second sealing elements mounted adjacently to the impellers to separate a scroll, in which said set of blades of the impellers rotates, from an inner chamber closer to said shaft than the scroll, wherein each of said impellers is provided with first holes or channels that place said scroll, in which the blades of the impeller rotate, in communication with said inner chamber, wherein said discs of the impellers comprise one or more second holes or ducts that place said inner chamber in communication with said bearings, wherein said at least two supports of the bearings are provided with third holes or ducts configured for passage of gas, and wherein an upper end of said shaft extends into a containment cup, an internal magnet being housed in said containment cup, said internal magnet having one or more grooves that enable a movement of said gas within said containment cup.

10. The regenerative compressor according to claim 3, further comprising a communication duct which places said inner chamber in communication with a suction chamber of each of said impellers and through which gas coming from said coupling flows into the suction chamber and mixes with inflowing gas.

11. A regenerative compressor, configured to work at pressures exceeding 50 bars, comprising:

a motor;

a magnetic drive coupling connected to said motor and configured to transmit a rotary motion to a drive shaft, said drive shaft being mechanically connected to said magnetic drive coupling; and a plurality of impellers, each of said impellers being mechanically connected, directly or indirectly, to said drive shaft, each of said impellers being of a peripheral impeller and comprising a disc equipped with a set of blades mounted on one or both of two sides of the disc, wherein said drive shaft is supported by bearings in at least two supports, and wherein said plurality of impellers is mounted on said drive shaft in a space included between said at least two supports;

further comprising a tangential fan located at a lower end of said shaft and disposed to direct gas downwards.

12. A regenerative compressor, configured to work at pressures exceeding 50 bars, comprising:

a motor;

a magnetic drive coupling connected to said motor and configured to transmit a rotary motion to a drive shaft, said drive shaft being mechanically connected to said magnetic drive coupling; and a plurality of impellers, each of said impellers being mechanically connected, directly or indirectly, to said drive shaft, each of said impellers being of a peripheral impeller and comprising a disc equipped with a set of blades mounted on one or both sides of two sides of the disc, wherein said drive shaft is supported by bearings in at least two supports, wherein said plurality of impellers is mounted on said drive shaft in a space included between said at least two supports, and wherein said shaft is provided with an axial hole for passage of gas along said shaft, further comprising an internal magnet housed in a passage between an outer wall of said shaft and an internal wall of a containment cup containing said magnetic drive coupling, and wherein an external surface of said internal magnet comprises one or more grooves configured to guide a gas flow in an area of said containment cup.

* * * * *